US010851774B2

(12) United States Patent
Al Assad et al.

(10) Patent No.: US 10,851,774 B2
(45) Date of Patent: Dec. 1, 2020

(54) CONTROLLER AND METHOD OF CONTROLLING A ROD PUMPING UNIT

(71) Applicant: General Electric Company, Schenectady, NY (US)

(72) Inventors: Omar Al Assad, Niskayuna, NY (US); Rogier Sebastiaan Blom, Balston Lake, NY (US); Gary Hughes, Missouri City, TX (US); Justin Edwin Barton, Glenville, NY (US); Peter Westerkamp, Missouri City, TX (US)

(73) Assignee: Ravdos Holdings Inc., New York, NY (US)

( * ) Notice: Subject to any disclaimer, the term of this patent is extended or adjusted under 35 U.S.C. 154(b) by 70 days.

(21) Appl. No.: 14/945,163

(22) Filed: Nov. 18, 2015

(65) Prior Publication Data

US 2017/0037845 A1 Feb. 9, 2017

Related U.S. Application Data

(60) Provisional application No. 62/201,708, filed on Aug. 6, 2015.

(51) Int. Cl.

| | |
|---|---|
| ***F04B 49/20*** | (2006.01) |
| ***F04B 47/02*** | (2006.01) |
| ***F04B 53/14*** | (2006.01) |
| ***F04B 19/22*** | (2006.01) |
| ***F04B 51/00*** | (2006.01) |
| ***E21B 43/12*** | (2006.01) |
| ***E21B 47/00*** | (2012.01) |
| ***E21B 47/008*** | (2012.01) |

(52) U.S. Cl.

CPC ..... *F04B 49/20* (2013.01); *E21B 43/126* (2013.01); *E21B 47/008* (2020.05); *F04B 19/22* (2013.01); *F04B 47/022* (2013.01); *F04B 51/00* (2013.01); *F04B 53/14* (2013.01)

(58) Field of Classification Search

CPC ..... F04B 19/22; F04B 49/20; F04B 47/022; F04B 51/00; F04B 53/14; E21B 43/126; E21B 47/0007

USPC ..... 417/42

See application file for complete search history.

(56) References Cited

U.S. PATENT DOCUMENTS

2008/0240930 A1* 10/2008 Palka ..... E21B 43/127 417/42
2011/0103974 A1* 5/2011 Lamascus ..... F04B 47/02 417/45
2013/0018605 A1* 1/2013 Peterson ..... G01F 25/0061 702/55

(Continued)

OTHER PUBLICATIONS

T.A. Everitt et al., "An Improved Finite-Difference Calculation of Downhole Dynamometer Cards for Sucker-Rod Pumps", SPE Production Engineering, pp. 121-127, 1992.

*Primary Examiner* — Connor J Tremarche
(74) *Attorney, Agent, or Firm* — Dentons Cohen & Grigsby P.C.

(57) ABSTRACT

A controller for operating a rod pumping unit at a pump speed. The controller includes a processor configured to operate a pump piston of the rod pumping unit at a first speed. The processor is further configured to determine a pump fillage level for a pump stroke based on a position signal and a load signal. The processor is further configured to reduce the pump speed to a second speed based on the pump fillage level for the pump stroke.

18 Claims, 7 Drawing Sheets

(56) References Cited

U.S. PATENT DOCUMENTS

| | | | | |
|---|---|---|---|---|
| 2013/0104645 | A1* | 5/2013 | Pons | F04B 49/065 73/152.61 |
| 2016/0265321 | A1* | 9/2016 | Elmer | G05B 19/042 |
| 2017/0268500 | A1 | 9/2017 | Al Assad et al. | |

* cited by examiner

CONTROLLER AND METHOD OF CONTROLLING A ROD PUMPING UNIT

PRIORITY

This application claims the benefit of U.S. Provisional Application No. 62/201,708, filed Aug. 6, 2015, titled "System and Methods for Control of Rod Pumps," which is incorporated herein by reference in its entirety.

BACKGROUND

The field of the disclosure relates generally to rod pumping units and, more particularly, to a rod pumping unit control system and a method of controlling a rod pumping unit.

Most known rod pumping units (also known as surface pumping units) are used in wells to induce fluid flow, for example oil and water. Examples of rod pumping units include, for example, and without limitation, linear pumping units and beam pumping units. Rod pumping units convert rotating motion from a prime mover, e.g., an engine or an electric motor, into reciprocating motion above the well head. This motion is in turn used to drive a reciprocating down-hole pump via connection through a sucker rod string. The sucker rod string, which can extend miles in length, transmits the reciprocating motion from the well head at the surface to a subterranean piston, or plunger, and valves in a fluid bearing zone of the well. The reciprocating motion of the piston valves induces the fluid to flow up the length of the sucker rod string to the well head.

Components including, for example, and without limitation, motors, rods, and gearboxes of rod pumping units are exposed to a wide range of stresses. Such stresses fatigue various components of the rod pumping unit and reduce the service life of the equipment. Moreover, such stresses increase the likelihood of a rod pumping unit or rod pumping unit component failure. Reduced service life and failures introduce cost for an operator of the rod pumping unit. These costs may include, for example, service costs, component replacement cost, and down time and production loss costs.

Most known rod pumping units include a rod pumping unit controller that drives the rod pumping unit in a manner intended to minimize component failures and extend the service life of the rod pumping unit. For example, a rod pumping unit controller may operate the rod pumping unit at certain speeds that are within the bounds of a manufacturer's operating specifications. Such rod pumping unit controllers do not remove all stresses from operating the rod pumping unit. Certain stresses and the conditions that cause those stresses vary over time while the rod pumping unit operates. One such stress is that caused by fluid pound. Fluid pound occurs when the pump piston strikes the surface of the fluid in the pump. The occurrence of fluid pound and the stresses it creates on the rod, motor, and gearbox of the rod pumping unit varies during the course of operation. For example, variations in reservoir inflow, pressure, and pump fillage affect at what point in a piston stroke the piston strikes the surface of the fluid.

BRIEF DESCRIPTION

In one aspect, a controller for a rod pumping unit is provided. The controller operates the rod pumping unit at a pump speed. The controller includes a processor configured to operate a pump piston of the rod pumping unit at a first speed. The processor is further configured to determine a pump fillage level for a pump stroke based on a position signal and a load signal. The processor is further configured to reduce the pump speed to a second speed based on the pump fillage level for the pump stroke.

In another aspect, a method of controlling a rod pumping unit is provided. The method includes determining a pump piston position and a pump piston load. The method also includes computing a pump fillage level based on the pump piston position and the pump piston load. The method further includes operating the rod pumping unit at a predetermined pump speed equal to a first speed. The method also includes reducing the predetermined pump speed to a second speed based on the pump fillage level and the pump piston position. The method further includes increasing the predetermined pump speed to a third speed after the pump piston contacts a fluid surface within a barrel of the rod pumping unit.

In yet another aspect, a rod pumping unit is provided. The rod pumping unit includes a pump, a rod, and a controller. The subsurface pump includes a pump piston operable within a barrel. The rod is coupled to a motor and the pump, and is configured to operate the pump at a predetermined pump speed. The controller is coupled to the motor and is configured to drive the pump piston on a downstroke at the predetermined pump speed. The predetermined pump speed is equal to a first speed. The controller is further configured to decelerate the pump piston on the downstroke to make the predetermined pump speed equal to a second speed. The controller is further configured to accelerate the pump piston on the downstroke after the pump piston contacts a fluid surface within the barrel.

DRAWINGS

These and other features, aspects, and advantages of the present disclosure will become better understood when the following detailed description is read with reference to the accompanying drawings in which like characters represent like parts throughout the drawings, wherein.

Figure 1:
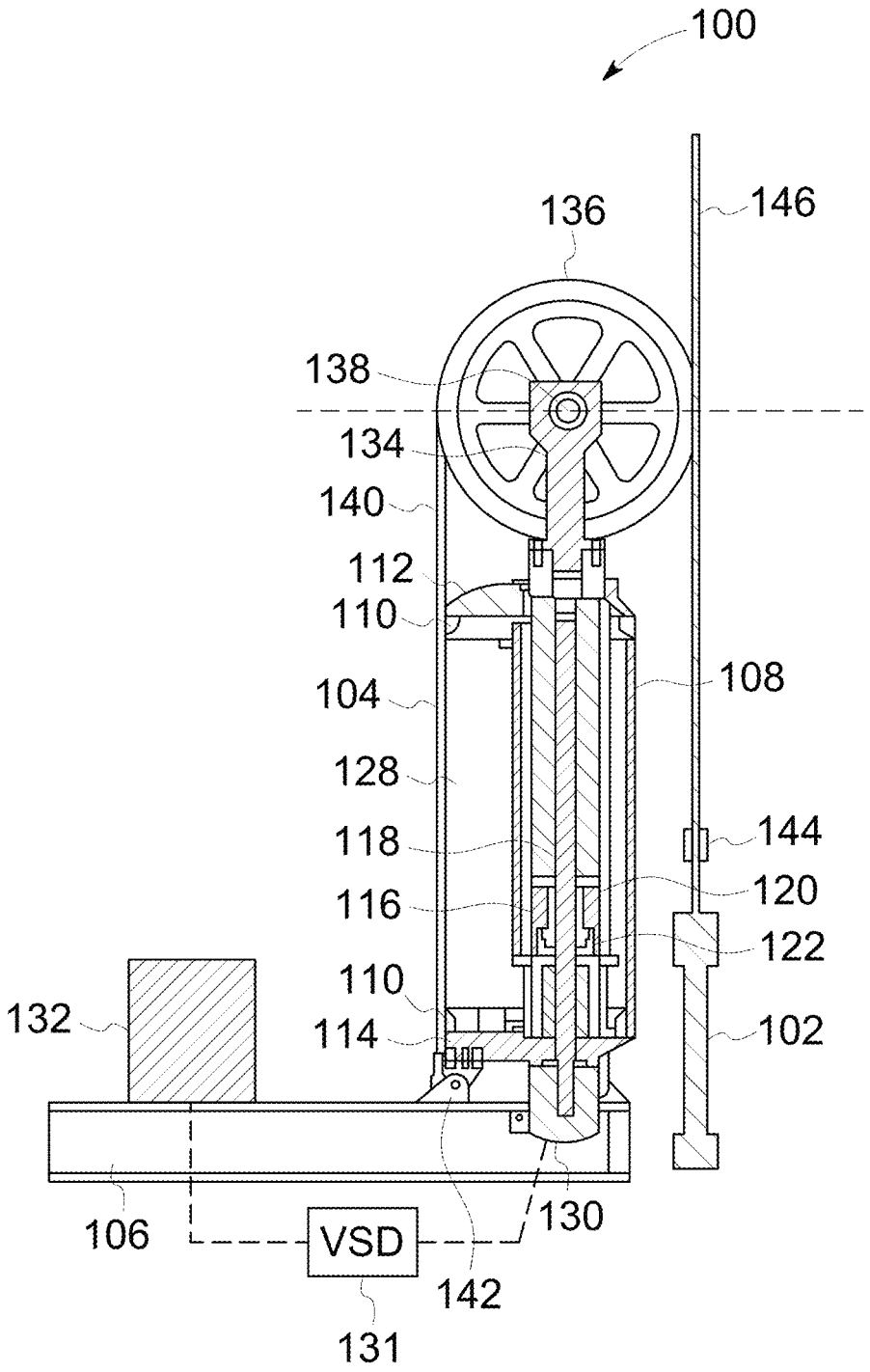
FIG. 1 is a cross-sectional view of an exemplary rod pumping unit in a fully retracted position.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc—read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

Embodiments of the present disclosure relate to control of rod pumping units. The rod pumping units and rod pumping unit controllers described herein provide real-time monitoring of stresses within a pump stroke, including, for example, and without limitation, stresses from fluid pound. Controllers described herein use variable pump speeds within the pump stroke to slow the pump piston leading up to contact with the fluid surface in the barrel of the pump. Once the pump piston contacts the fluid surface, the pump speed is increased to maintain the overall average pump speed for the pump stroke. Controllers described herein are further configured to monitor stresses that occur within the pump stroke as a result of using variable pump speeds within the pump stroke. Controllers described herein further modulate the variable pump speed within the pump stroke to mitigate over-stresses as they occur.

Figure 2:
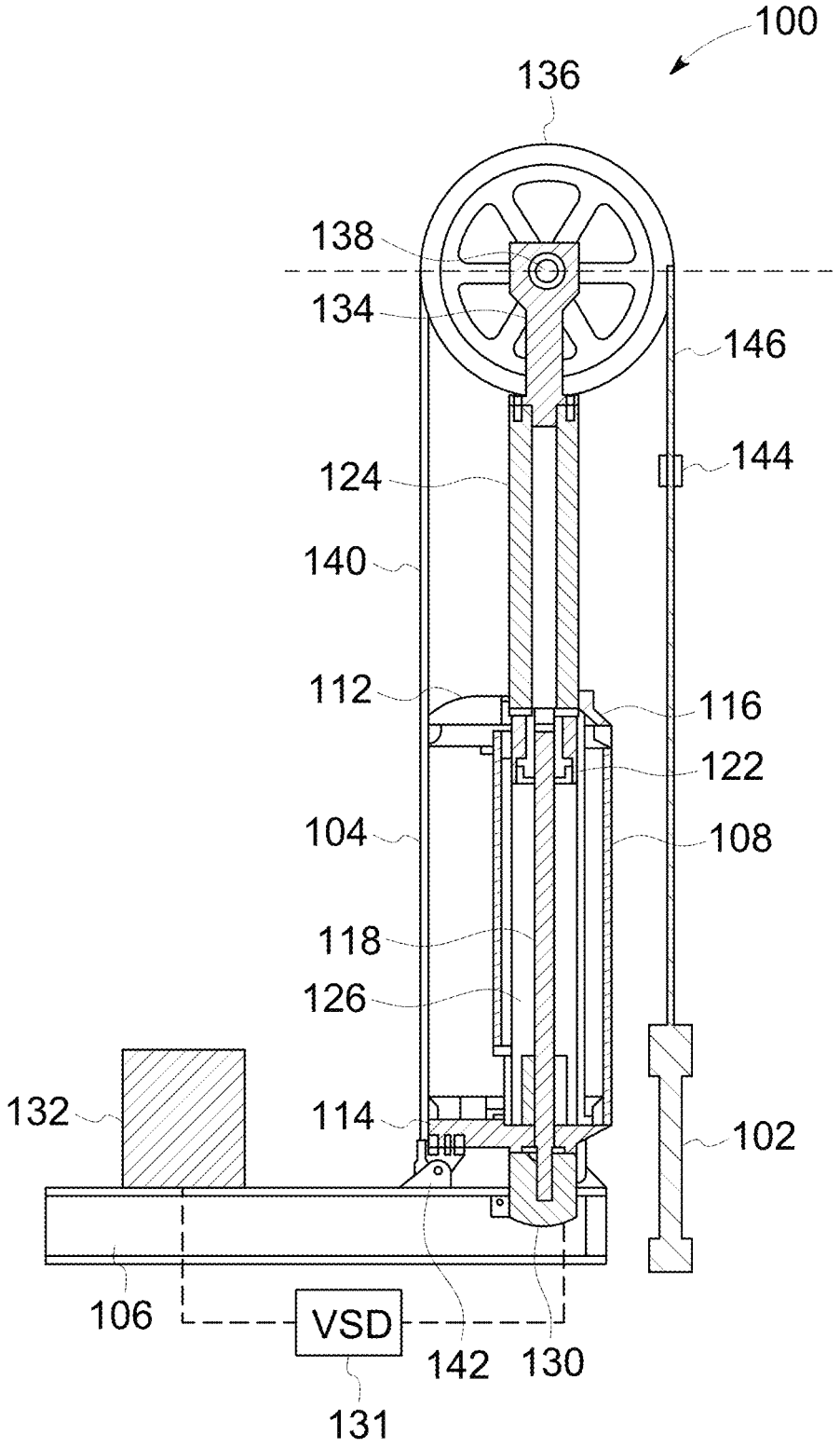
FIG. 2 is a cross-sectional view of the rod pumping unit shown in FIG. 1 in a fully extended position.

FIGS. 1 and 2 are cross-sectional views of an exemplary rod pumping unit 100 in fully retracted (1) and fully extended (2) positions, respectively. In the exemplary embodiment, rod pumping unit 100 (also known as a linear pumping unit) is a vertically oriented rod pumping unit having a linear motion vertical vector situated adjacent to a well head 102. Rod pumping unit 100 is configured to transfer vertical linear motion into a subterranean well (not shown) through a sucker rod string (not shown) for inducing the flow of a fluid. Rod pumping unit 100 includes a pressure vessel 104 coupled to a mounting base structure 106. In some embodiments, mounting base structure 106 is anchored to a stable foundation situated adjacent to the fluid-producing subterranean well. Pressure vessel 104 may be composed of a cylindrical or other appropriately shaped shell body 108 constructed of formed plate and cast or machined end flanges 110. Attached to the end flanges 110 are upper and lower pressure heads 112 and 114, respectively.

Penetrating upper and lower pressure vessel heads 112 and 114, respectively, is a linear actuator assembly 116. This linear actuator assembly 116 is includes a vertically oriented threaded screw 118 (also known as a roller screw), a planetary roller nut 120 (also known as a roller screw nut assembly), a forcer ram 122 in a forcer ram tube 124, and a guide tube 126.

Roller screw 118 is mounted to an interior surface 128 of lower pressure vessel head 114 and extends up to upper pressure vessel head 112. The shaft extension of roller screw 118 continues below lower pressure vessel head 114 to connect with a compression coupling (not shown) of a motor 130. Motor 130 is coupled to a variable speed drive (VSD) 131 configured such that the motor's 130 rotating speed may be adjusted continuously. VSD 131 also reverses the motor's 130 direction of rotation so that its range of torque and speed may be effectively doubled. Roller screw 118 is operated in the clockwise direction for the upstroke and the counter-clockwise direction for the downstroke. Motor 130 is in communication with a rod pumping unit controller 132. In the exemplary embodiment, pumping unit controller 132 transmits commands to motor 130 and VSD 131 to control the speed, direction, and torque of roller screw 118.

Within pressure vessel 104, the threaded portion of roller screw 118 is interfaced with planetary roller screw nut assembly 120. Nut assembly 120 is fixedly attached to the lower segment of forcer ram 122 such that as roller screw 118 rotates in the clockwise direction, forcer ram 122 moves upward. Upon counterclockwise rotation of roller screw 118, forcer ram 122 moves downward. This is shown generally in FIGS. 1 and 2. Guide tube 126 is situated coaxially surrounding forcer tube 124 and statically mounted to lower pressure head 114. Guide tube 126 extends upward through shell body 108 to slide into upper pressure vessel head 112.

An upper ram 134 and a wireline drum assembly 136 and fixedly coupled and sealed to the upper end of forcer ram 122. Wireline drum assembly 136 includes an axle 138 that passes laterally through the top section of the upper ram 134. A wireline 140 passes over wireline drum assembly 136 resting in grooves machined into the outside diameter of wireline drum assembly 136. Wireline 140 is coupled to anchors 142 on the mounting base structure 106 at the side of pressure vessel 104 opposite of well head 102. At the well head side of pressure vessel 104, wireline 140 is coupled to a carrier bar 144 which is in turn coupled to a polished rod 146 extending from well head 102.

Rod pumping unit 100 transmits linear force and motion through planetary roller screw nut assembly 120. Motor 130 is coupled to the rotating element of planetary roller screw nut assembly 120. By rotation in either the clockwise or counterclockwise direction, motor 130 may affect translatory movement of planetary roller nut 120 (and by connection, of forcer ram 122) along the length of roller screw 118.

Figure 3:
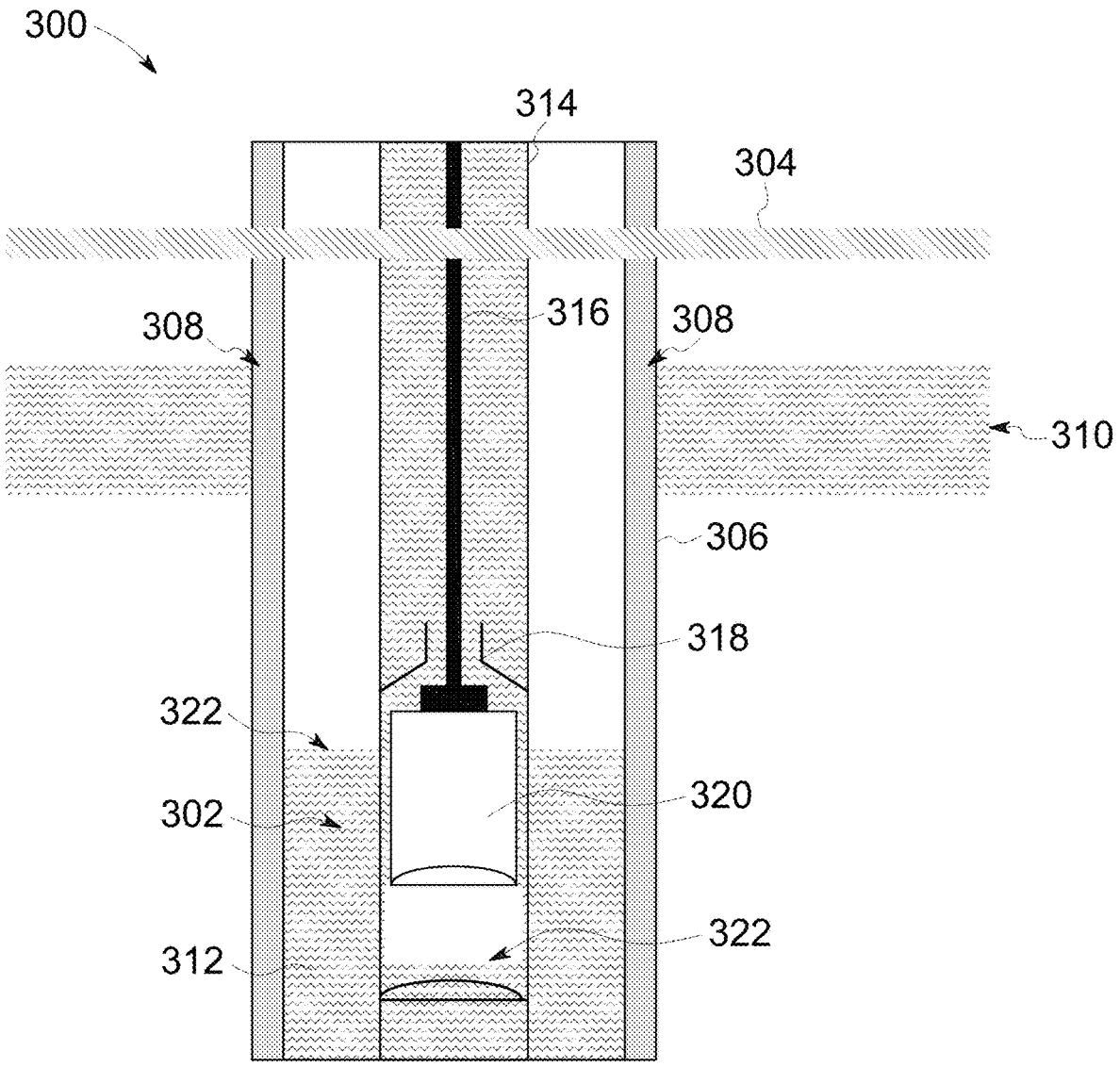
FIG. 3 is a cross-sectional view of an exemplary down-hole well for the rod pumping unit shown in FIGS. 1 and 2.

FIG. 3 is a cross-sectional view of an exemplary downhole well 300 for rod pumping unit 100 shown in FIGS. 1 and 2. Downhole well 300 includes a pump 302 below a surface 304. Downhole well 300 includes a casing 306 that lines the well. Casing 306 includes perforations 308 in a fluid bearing zone 310. Perforations 308 facilitate flow of a fluid, such as, for example, and without limitation, oil or water, into downhole well 300.

Downhole well 300 includes tubing 314 that facilitates extraction of fluid 312 from downhole well 300 to surface 304. Pump 302 generates pressure within downhole well 300 that pushes fluid 312 to up to surface 304 through tubing 314. Pump 302 is coupled to a rod 316, sometimes referred to as a sucker rod string. Rod 316 further couples to well head 102 (shown in FIGS. 1 and 2) at surface 304, through which rod 316 couples to motor 130 (also shown in FIGS. 1 and 2).

Pump 302 includes a barrel 318 within which a pump piston 320 translates up and down. Pump piston 320 is translated up and down by rod 316, which is driven by motor 130, generating pressure within downhole well 300. As pump piston 320 translates down, on a downstroke, piston 320 contacts a surface 322 of fluid 312. This surface contact generates stress on rod 316 and motor 130, as well as any gearing or gear box (not shown) through which they connect. The stress is referred to as fluid pound. Pump piston 320 translates up on an upstroke. One downstroke and one upstroke define a pump stroke. During a pump stroke, acceleration and deceleration stresses act on rod 316, motor 130, and other components of rod pumping unit 100.

Figure 4:
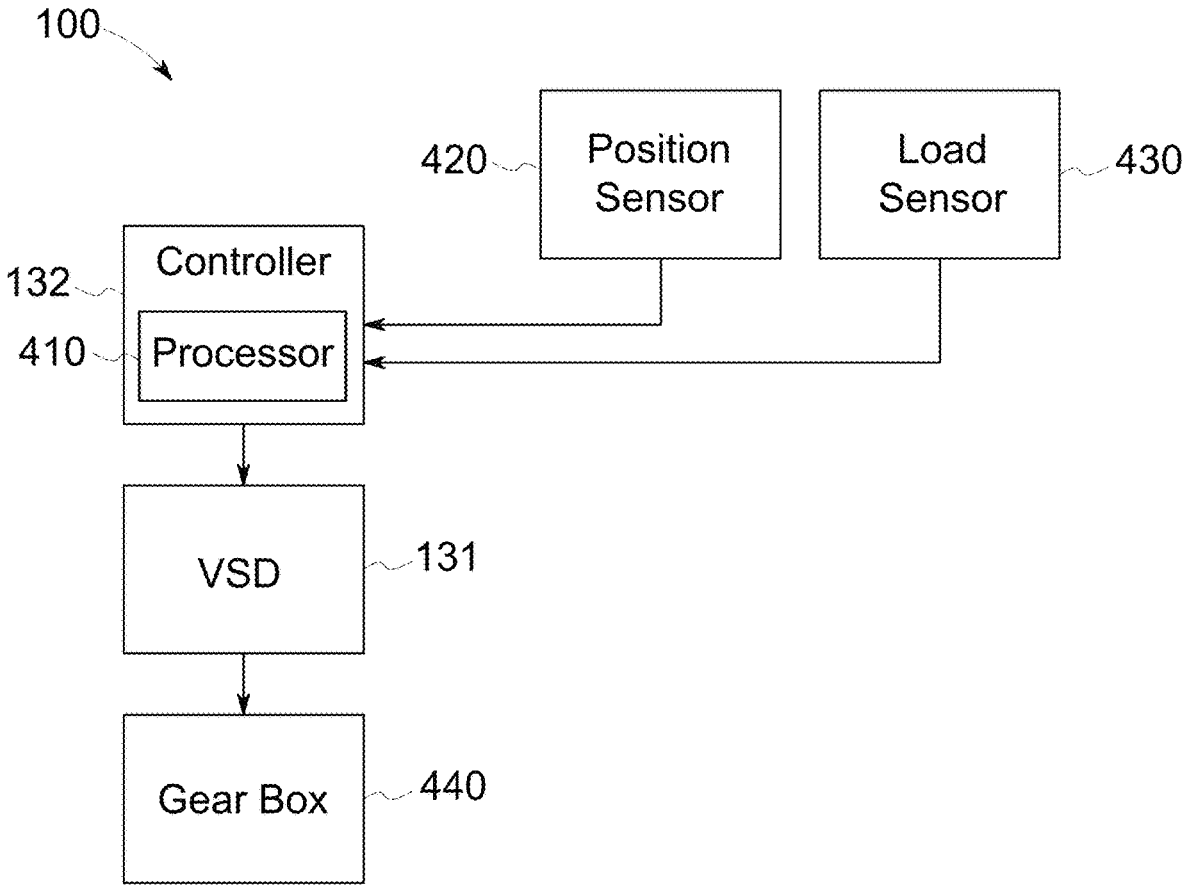
FIG. 4 is a block diagram of the rod pumping unit shown in FIGS. 1 and 2.

FIG. 4 is a block diagram of rod pumping unit 100 (shown in FIGS. 1 and 2) that includes controller 132 and motor 130 (both shown in FIGS. 1 and 2). Controller 132 includes a processor 410. Rod pumping unit 100 further includes a position sensor 420 and a load sensor 430. Position sensor 420 and load sensor 430 are disposed at the surface and are configured to measure the position of and load on polished rod 146 (shown in FIGS. 1 and 2). The surface measurements of position and load are related to downhole position and load on rod 316 (shown in FIG. 3).

Controller 132 drives pump 302 using motor 130 through a gear box 440 at a pump speed measured in strokes per minute (SPM). Controller 132 computes an average pump speed for a pump stroke based on pump fillage. Pump fillage refers to the level of fluid 312 filling barrel 318 of pump 302 (all shown in FIG. 3). Controller 132 controls the average pump speed to maintain the highest pump fillage level possible. If pump fillage is low, controller 132 drives motor 130, gear box 440, and pump 302 more slowly. If pump fillage is high, controller 132 is free to drive motor 130, gear box 440, and pump 302 as quick as other limitations on rod pumping unit 100 allow.

During operation of rod pumping unit 100, processor 410 is configured to receive a position signal from position sensor 420 and a load signal from load sensor 430. Processor 410, in real-time, computes a pump card that includes the downhole position of pump piston 320 (shown in FIG. 3) and the downhole load on rod 316. The real-time pump card represents the translation of surface position and load measurements to downhole position and load.

Processor 410 is further configured to compute a pump fillage level based on the real-time pump card. The position and load information in the real-time pump card indicates a position that pump piston 320 contacts fluid surface 322, for example, by the occurrence of a load spike. Processor 410 sets a target average pump speed for the stroke based on the pump fillage level, which is assumed to be constant throughout a pump stroke. Processor 410 uses the position of contact with fluid surface 322 from a previous stroke as the predicted position of contact with fluid surface 322 in the current downstroke.

During a downstroke, processor 410 is further configured to reduce the pump speed from the initial target pump speed as pump piston 320 approaches fluid surface 322. By slowing pump piston 320 before contact with fluid surface 322, the stresses of fluid pound are reduced. Once contact with fluid surface 322 is made, pump piston 320 is accelerated. The reduction in pump speed is configurable based on the acceptable level of fluid pound stresses. For example, a user of controller 132, in certain embodiments, specifies a percent reduction in pump speed. In alternative embodiments, the user specifies an absolute reduction in pump speed or an absolute pump speed at which pump piston 320 should contact fluid surface 322.

Processor 410 is configured to decelerate pump piston 320 based on the pump fillage level to achieve the user-desired reduction in pump speed. Once contact with fluid surface 322 is made, processor 410 accelerates pump piston 320 to maintain the initial target average pump speed. Accordingly, controller 132 drives pump 302 at a variable speed within a stroke, but at the target average speed stroke-to-stroke.

Processor 410 is further configured to compute and monitor stresses on rod pumping unit 100 in real-time using a rod pumping unit dynamics model. More specifically, processor 410 uses the surface measurements from position sensor 420 and load sensor 430 to estimate stresses on rod 316, power on motor 130, and torque on gear box 440. The stresses vary within a pump stroke as a consequence of the variable pump speed at which controller 132 drives motor 130, gear box 440, and rod 316. The rod pumping unit dynamics model comprehends inertial aspects of the stresses and facilitates real-time monitoring.

During operation, processor 410 may detect an over-stress in either of rod 316, motor 130, and gear box 440. In the event of an over-stress, processor 410 is configured to reduce acceleration applied to motor 130, gear box 440, and rod 316. For example, during a downstroke, pump piston 320 translates down toward fluid surface 322 at a first speed. Processor 410 is configured to reduce the pump speed to a second speed leading up to contact with fluid surface 322. Processor 410 decelerates pump 302 to bring the pump speed down to the second speed. Processor 410, using the rod pumping unit dynamics model, detects an over-stress in at least one of motor 130, gear box 440, and rod 316 as pump 302 is decelerated. Processor 410 is configured to mitigate the detected over-stress by reducing the deceleration being applied to motor 130, gear box 440, and rod 316. In this example, the pump speed is not completely reduced from the first speed to the second speed, and pump piston 320 contacts fluid surface 322 at a higher speed than initially planned. Accordingly, once pump piston 320 contacts fluid surface 322, pump 302 is accelerated to a third speed to maintain the target average speed for the pump stroke. Processor 410 is configured to compute the third speed in real-time based on the pump speed to that time in the pump stroke and the target average pump speed. The third speed, in this example, is lower than would have been necessary had pump piston 320 contacted fluid surface 322 at the planned second speed. The detected over-stress resulted in the second speed not being achieved. Consequently, the third speed does not need to be as high to maintain the target average pump speed for the stroke.

Figure 5:
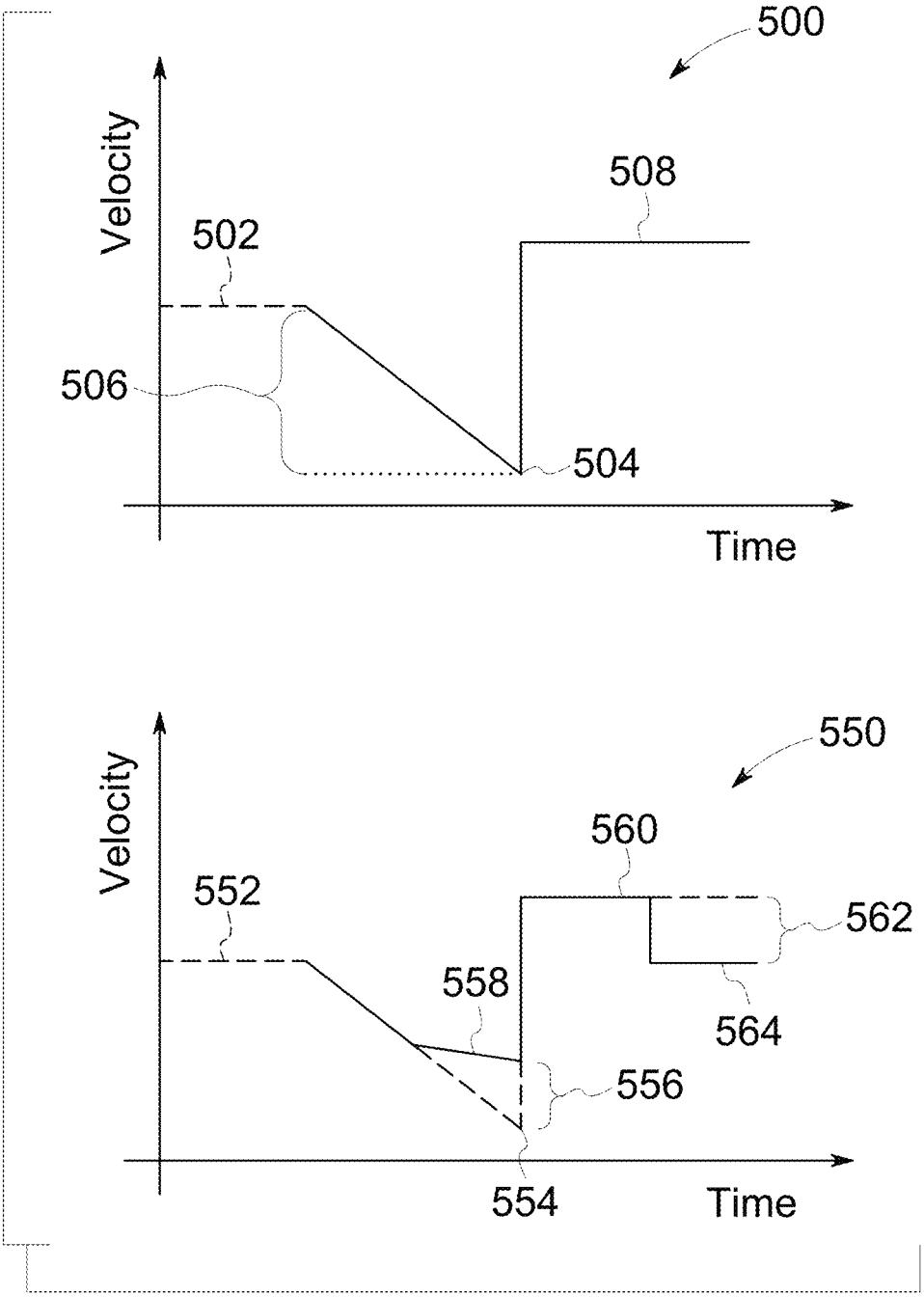
FIG. 5 is a diagram of exemplary velocity profiles for the rod pumping unit shown in FIGS. 1 and 2.

FIG. 5 illustrates two exemplary velocity profiles 500 and 550 for rod pumping unit 100 (shown in FIGS. 1 and 2). Velocity profiles 500 and 550 are expressed as a function of time. Further, velocity profiles 500 and 550 would undergo further processing to smooth velocity transitions before being used by controller 132 to drive motor 130 and pump 302. Referring to FIGS. 3, 4, and 5, velocity profile 500 includes a first speed 502 at which pump 302 is operable. Velocity profile 500 illustrates a contact point 504 where pump piston 320 contacts fluid surface 322. Contact point 504 is determined based on a previous pump stroke, and is assumed to be the contact point for the current pump stroke. Although velocity profile 500 is expressed in terms of time, contact point 504 is expressed as a position in the pump stroke.

Velocity profile 500 includes a deceleration 506 to reduce first speed 502 to a second speed at contact point 504. The slope of deceleration 506 is determined by controller 132. When pump piston 320 contacts fluid surface 322, the pump speed is increased from the second speed to a third speed 508. Third speed 508 is higher than first speed 502 to maintain an initial target average pump speed for the pump stroke.

Velocity profile 550 includes a first speed 552 at which pump 302 is operable. Velocity profile 550 illustrates a contact point 554 where pump piston 320 contacts fluid surface 322. The pump speed is reduced from the first speed to a second speed when pump piston 320 contacts fluid surface 322. However, an over-stress is detected during deceleration of pump piston 320 during the downstroke. As a result, velocity profile 550 undergoes a modulation 556 to reduce the deceleration and to mitigate the detected over-stress. Consequently, the pump speed is not completely reduced from the first speed to the second speed contact point 554. Rather, pump piston 320 contacts fluid surface at a modulated speed 558.

Once pump piston 320 contacts fluid surface 322, the pump speed is increased to a third speed 560. Third speed 560 is computed to maintain the target average pump speed for the pump stroke.

Another over-stress is detected while pump 302 is operating at third speed 560 during the pump stroke. As a result, velocity profile 550 undergoes a modulation 562 to reduce the pump speed from third speed 560 to a fourth speed 564. This reduced speed mitigates the over-stress.

Figure 6:
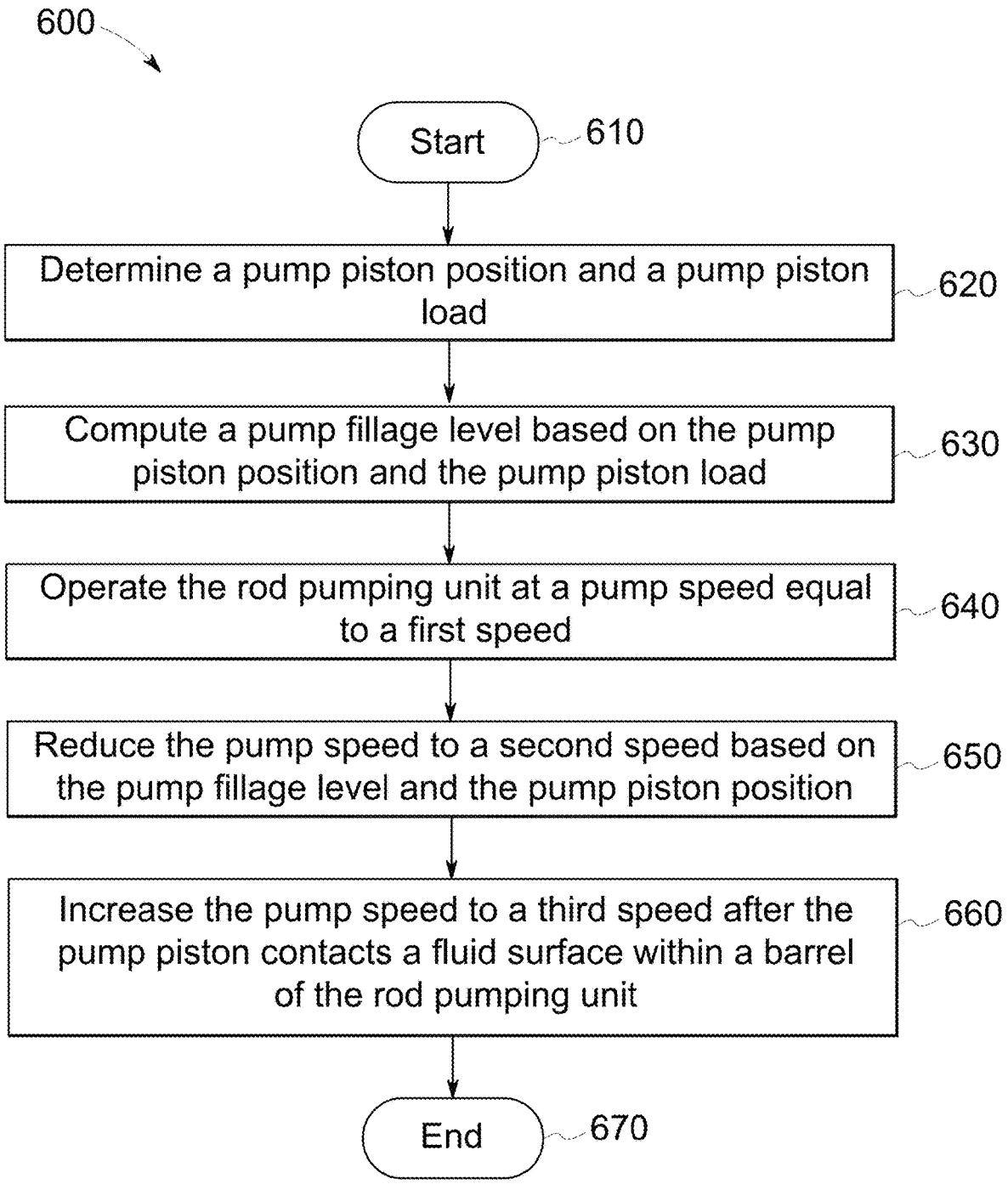
FIG. 6 is a flow diagram of an exemplary method of controlling the rod pumping unit shown in FIGS. 1 and 2.

FIG. 6 is a flow diagram of an exemplary method 600 of controlling rod pumping unit 100 (shown in FIGS. 1 and 2). The method begins at a start step 610. At a measuring step 620, position sensor 420 and load sensor 430 measure a surface position and a surface load that translate to a pump piston position and a pump piston load. These downhole values are computed on a real-time pump card by controller 132.

At a pump fillage recovery step 630, controller 132 determines the pump fillage level based on the pump piston position and the pump piston load. The pump fillage level is the basis for computing an average pump speed for a pump stroke. The pump fillage level is also the basis for determining a contact point at which pump piston 320 will contact fluid surface 322.

At a downstroke step 640, rod pumping unit 100 is operated at a pump speed equal to a first speed. As pump piston 320 approaches fluid surface 322, at a speed reduction step 650, the pump speed is reduced from the first speed to a second speed, such that pump piston 320 contacts fluid surface 322 at a slower speed to reduce stresses of fluid pound.

After pump piston 320 contacts fluid surface 322, at an acceleration step 660, the pump speed is increased to a third speed to maintain the average pump speed for the pump stroke. The method ends at an end step 670.

Figure 7:
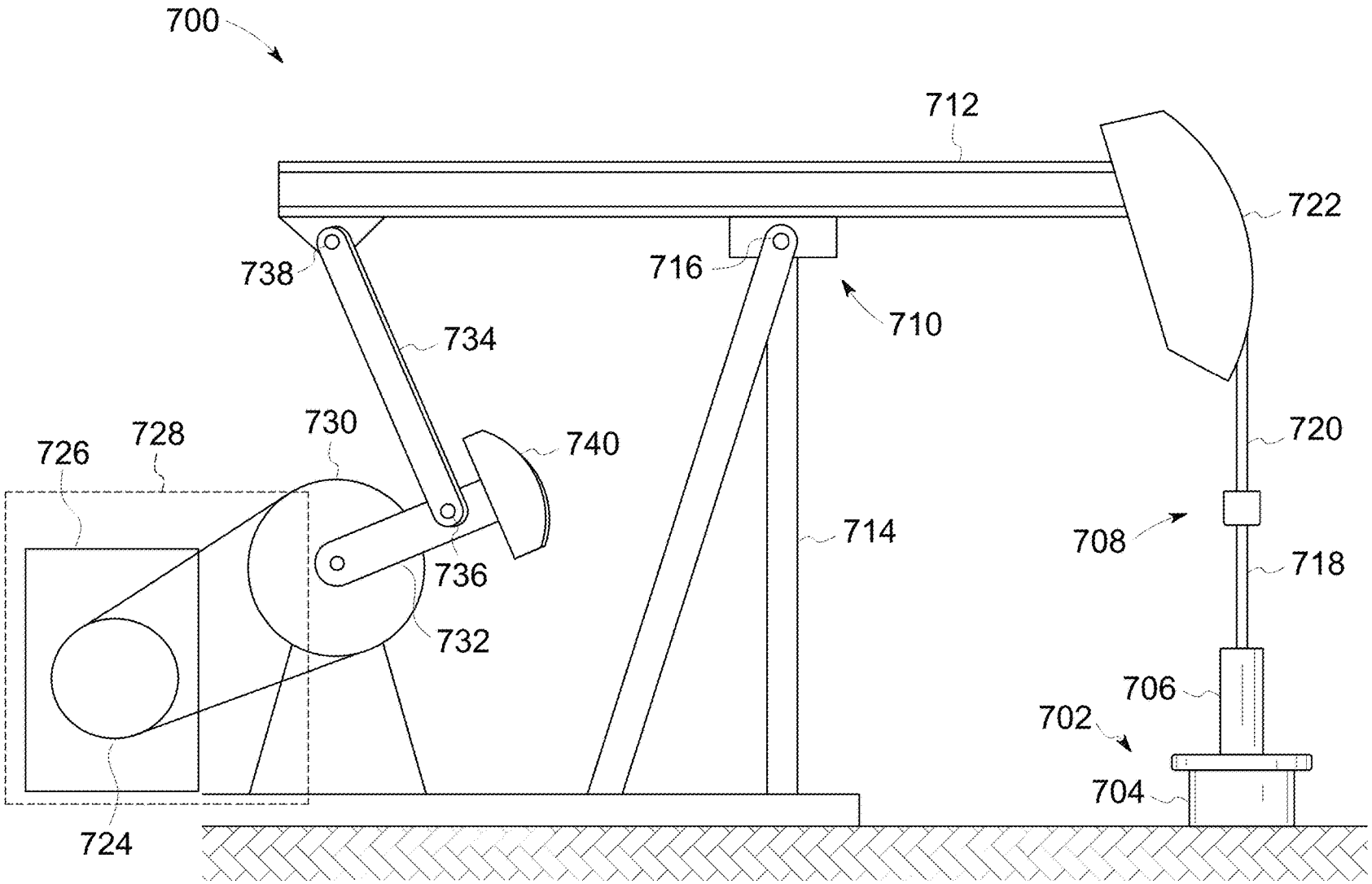
FIG. 7 is a diagram of an exemplary beam-type rod pumping unit.

FIG. 7 is a diagram of an exemplary beam-type rod pumping unit, beam pumping unit 700 for use at a well head 702 of a well that extends beneath the surface for the purpose of producing gas and fluid, such as downhole well 300 (shown in FIG. 3). Well head 702 includes an upper portion of a casing 704 and tubing 706. Casing 704 and tubing 706 extend into the well to facilitate a downhole pump, such as pump 302 (shown in FIG. 3), that is actuated by a rod 708 to produce the gas and fluid.

Beam pumping unit 700 includes a surface support unit 710 that suspends rod 708 in the well. Surface support unit 710 includes a walking beam 712 pivotally coupled to a Samson post 714 by a pin 716. Rod 708 includes polished rod 718 that extends into casing 704 and tubing 706 through well head 702. Rod 708 also includes a cable 720 that flexibly couples rod 708 to walking beam 712 at a horsehead 722.

Beam pumping unit 700 is driven by a motor 724 through a gear box 726. Together, motor 724 and gear box 726 form a drive system 728 that, in certain embodiments, may include one or more belts, cranks, or other components. Through gear box 726, motor 724 turns a crank 730 having a crank arm 732. Crank arm 732 is coupled to walking beam 712 at an end opposite horsehead 722 by a pitman arm 734. Pitman arm 734 pivotably couples to crank arm 732 by a pin 736, and further pivotably couples to walking beam 712 by a pin 738. Pitman arm 734 is configured to translate angular motion of crank arm 732 into linear motion of walking beam 712. The linear motion of walking beam 712 provides the reciprocal motion of rod 708 for operating the downhole pump.

On an upstroke of beam pumping unit 700, the weight of rod 708, which is suspended from walking beam 712, is transferred to crank 730 and drive system 728. Crank arm 732 includes a counterweight 740 that is configured to reduce the load on drive system 728 during an upstroke.

The above described rod pumping unit and rod pumping unit controllers provide real-time monitoring of stresses within a pump stroke, including, for example, and without limitation, stresses from fluid pound. Controllers described herein use variable pump speeds within the pump stroke to slow the pump piston leading up to contact with the fluid surface in the barrel of the pump. Once the pump piston contacts the fluid surface, the pump speed is increased to maintain the overall average pump speed for the pump stroke. Controllers described herein are further configured to monitor stresses that occur within the pump stroke as a result of using variable pump speeds within the pump stroke. Controllers described herein further modulate the variable pump speed within the pump stroke to mitigate over-stresses as they occur.

An exemplary technical effect of the methods, systems, and apparatus described herein includes at least one of: (a) real-time monitoring of stresses within a pump stroke; (b) reducing stresses of fluid pound by slowing the pump speed leading up to fluid surface contact; (c) modulating pump speed within a pump stroke to mitigate stresses caused by fluid pound and accelerations within the pump stroke; (d) facilitating operation of rod pumping units within manufacturer and operator specifications; (e) improving service life of rod pumping unit components; and (f) reducing maintenance time and downtime for rod pumping units.

Exemplary embodiments of methods, systems, and apparatus for rod pumping unit controllers are not limited to the specific embodiments described herein, but rather, components of systems and/or steps of the methods may be utilized independently and separately from other components and/or steps described herein. For example, the methods may also be used in combination with other non-conventional rod pumping unit controllers, and are not limited to practice with only the systems and methods as described herein. Rather, the exemplary embodiment can be implemented and utilized in connection with many other applications, equipment, and systems that may benefit from reduced cost, reduced complexity, commercial availability, improved reliability at high temperatures, and increased memory capacity.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A controller for operating a rod pumping unit, said controller comprising a processor configured to:

determine a pump fillage level for the pump stroke based on a position signal and a load signal;

establish an average pump speed based on the pump fillage level;

operate a pump piston of the rod pumping unit on a downstroke of a pump stroke;

decelerate the pump piston on the downstroke as the pump piston approaches a fluid surface in a barrel of a pump of the rod pumping unit;

detect if an overstress caused by the deceleration of the pump piston is present, wherein if the overstress caused by the deceleration of the pump piston is detected during the downstroke, the deceleration of the pump piston is reduced to mitigate the overstress; and increase the pump speed on the downstroke after the pump piston contacts the fluid surface in said barrel of said pump to achieve the established average pump speed.

2. The controller in accordance with claim 1, wherein said processor is further configured to compute a real-time pump card based on the position signal and the load signal, the pump card including a downhole position of the pump piston represented by the position signal, and a downhole load of the pump piston represented by the load signal.

3. The controller in accordance with claim 1, wherein said processor is further configured to determine the pump fillage level based on a fluid contact position during a previous pump stroke.

4. The controller in accordance with claim 3, wherein said processor is further configured to determine the fluid contact position based on the position of the pump piston and the load of the pump piston for the previous pump stroke.

5. The controller in accordance with claim 1, wherein said processor is further configured to compute real-time stresses on the rod pumping unit using a rod pumping unit dynamics model based on the position signal and the load signal.

6. The controller in accordance with claim 5, wherein said processor is further configured to modulate the pump speed based on the computed real-time stresses to control peak stresses on the rod pumping unit and to maintain the average pump speed over the pump stroke.

7. A method of controlling a rod pumping unit, said method comprising determining a pump piston position and a pump piston load;

computing a pump fillage level based on the pump piston position and the pump piston load;

operating the rod pumping unit at a pump speed equal to a first speed on a downstroke of the rod pumping unit;

reducing the predetermined pump speed on the downstroke to a second speed based on the pump fillage level and the pump piston position as the pump piston approaches a fluid surface in a barrel of the rod pumping unit, detecting if an overstress caused by the reduction in the predetermined pump speed is present, wherein if the overstress is detected during the downstroke, modulating the reduction of the predetermined pump speed on the downstroke to mitigate the overstress; and increasing the pump speed to a third speed on the downstroke after the pump piston contacts the fluid surface within the barrel of the rod pumping unit.

8. The method in accordance with claim 7 further comprising computing the first speed based on the pump fillage level.

9. The method in accordance with claim 7, wherein computing the pump fillage level comprises determining a previous pump piston position at which the pump piston contacted the fluid surface during a previous stroke.

10. The method in accordance with claim 7 further comprising receiving data indicative of the second speed from a user of the rod pumping unit.

11. The method in accordance with claim 7 further comprising computing real-time stresses on the rod pumping unit using a rod pumping unit dynamics model based on the pump piston position and the pump piston load.

12. The method in accordance with claim 11 further comprising modulating the pump speed based on the computed real-time stresses to control peak stresses on the rod pumping unit and to maintain the first speed on average.

13. A rod pumping unit, comprising:

a pump comprising a pump piston and a barrel, said pump piston operable within said barrel;

a rod coupled to a motor and said pump, said rod configured to operate said pump at a pump speed; and a controller coupled to said motor and configured to:

set a target average pump speed for the stroke based on the pump fillage level;

drive said pump piston on a downstroke at the pump speed, the pump speed equal to a first speed;

decelerate said pump piston on the downstroke to make the pump speed equal to a second speed as the pump piston approaches a fluid surface within said barrel, detect if an overstress is present while the pump piston is decelerated, wherein if the overstress is detected during the deceleration, the deceleration is reduced to mitigate the overstress; and accelerate said pump piston on the downstroke after said pump piston contacts the fluid surface within said barrel, wherein the pump piston is accelerated to a speed to achieve the target average pump speed for the pump stroke.

14. The rod pumping unit in accordance with claim 13 further comprising a position sensor and a load sensor configured to measure a position and a load of said rod at a well head for the rod pumping unit.

15. The rod pumping unit in accordance with claim 14, wherein said controller is coupled to said position sensor and said load sensor, said controller further configured to:

compute real-time stress on said rod pumping unit based on the position and the load using a rod pumping unit dynamics model; and modulate the predetermined pump speed according to the real-time stress.

16. The rod pumping unit in accordance with claim 14, wherein said controller is coupled to said position sensor and said load sensor, said controller further configured to compute a real-time pump card representing a pump piston position and a pump piston load.

17. The rod pumping unit in accordance with claim 13, wherein said controller is further configured to compute a pump fillage level based on a previous position at which the fluid surface was contacted on a previous downstroke, the pump fillage level corresponding to a position at which the fluid surface will be contacted on the downstroke.

18. The rod pumping unit in accordance with claim 17, wherein said controller is further configured to compute the first speed based on the pump fillage level.

* * * * *